US006471141B2

(12) United States Patent
Smith et al.

(10) Patent No.: US 6,471,141 B2
(45) Date of Patent: Oct. 29, 2002

(54) HOSE SPRAYER ASSEMBLY

(75) Inventors: Martin E. Smith, Camarillo; Stuart Daley, Simi Valley; James J. Styne, San Ramon; Stephen R. Dennis, Danville, all of CA (US)

(73) Assignee: Dispensing Technologies, L.L.C., Simi Valley, CA (US)

( * ) Notice: Subject to any disclaimer, the term of this patent is extended or adjusted under 35 U.S.C. 154(b) by 14 days.

(21) Appl. No.: 09/745,381

(22) Filed: Dec. 26, 2000

(65) Prior Publication Data

US 2002/0079381 A1 Jun. 27, 2002

Related U.S. Application Data

(60) Provisional application No. 60/210,410, filed on Jun. 8, 2000.

(51) Int. Cl.[7] ..... A62C 5/02; B05B 7/30

(52) U.S. Cl. ..... 239/10; 239/310; 239/318; 239/340; 239/414; 239/581.1; 137/893

(58) Field of Search ..... 239/10, 310, 318, 239/340, 354, 375, 530, 414, 518, 521, 524, 581.1; 137/625.41, 893, 894

(56) References Cited

U.S. PATENT DOCUMENTS 1,912,759 A * 6/1933 Clark ..... 239/414
3,212,716 A * 10/1965 Mills et al. ..... 239/318
4,281,796 A * 8/1981 Fugent et al. ..... 239/581.1
4,369,921 A 1/1983 Beiswenger et al.
4,651,930 A * 3/1987 Magaha, Jr. ..... 137/894
4,750,674 A 6/1988 Chow et al.
4,785,850 A 11/1988 Sanchez
5,100,059 A 3/1992 Englhard et al.
5,213,265 A 5/1993 Englhard et al.
5,356,076 A * 10/1994 Bishop ..... 239/318
5,655,714 A 8/1997 Kieffer et al.
5,954,272 A 9/1999 Chung Liao

* cited by examiner

*Primary Examiner*—Steven J. Ganey
(74) *Attorney, Agent, or Firm*—Kenneth J. Hovet; Arthur K. Samora

(57) ABSTRACT

A hose sprayer assembly in accordance with the present invention includes a trigger body which is rotatably mounted within a housing. The housing is formed with an inlet orifice, an outlet aperture and an aspiration orifice, and further includes a deflector plate which is fixed to the outer surface of the housing proximate the outlet aperture. The trigger body includes a inlet port, an outlet port in fluid communication with the inlet port, and an aspiration port in fluid communication with the outlet port. Selective alignment of the trigger body places the inlet port and outlet port in fluid communication with the respective inlet orifice and outlet aperture of the housing. This yields a water only stream out the housing outlet aperture when water is forced through the assembly. Similarly, the body can be aligned to place the aspiration port in fluid communication with the aspiration orifice of the housing. When the assembly is coupled to a container filled with product concentrate, this alignment yield a water/product stream. Yet another alignment directs the water/product stream onto the deflector plate to yield a fan-like spray pattern.

17 Claims, 5 Drawing Sheets

HOSE SPRAYER ASSEMBLY

This application claims priority from provisional patent application No. 60/210,410 which was filed Jun. 8, 2000.

FIELD OF THE INVENTION

The present invention pertains generally to sprayer assemblies. More specifically, the present invention pertains to disposable sprayer assemblies which can be connected to a garden hose and to a product container for delivery of a water/product mixture. The present invention is particularly useful as a multi-position sprayer assembly which allows for ergonomic operation with one hand for selective delivery of a water stream, a water/product stream or a water/product spray.

BACKGROUND OF THE INVENTION

Every year thousands of gallons of chemicals such as fertilizers or pesticides are applied to crops, plants, lawns, flowers, vegetable gardens and other organic type vegetation. Sprayed chemicals are also used as cleaning agents for homes and automobiles. Such chemical products are sold to consumers in concentrated form and therefore may be hazardous to the consumer and environment in general. Accordingly, the containers for the chemicals typically have a spray assembly permanently attached thereto. The sprayer assembly allows for delivery of the chemicals in a diluted form, usually as a chemical product/water mixture.

To allow for mixing with water, a typical sprayer assembly has a structure in which a fluid communication path exists between the concentrated product container and the sprayer assembly. During operation, an inlet end of the assembly is attached to a water source (usually a garden hose), and water is forced through the assembly. As the water flows past the fluid communication path for the product, a Venturi effect is created in accordance with well-known scientific principles which draws product out of the container. The product mixes with the water to create a water/product mixture which is then sprayed out an outlet end of the assembly. These sprayers are known in the art as aspiration-type sprayers.

Current aspiration sprayer assemblies are relatively complex in design, require many molded parts and are difficult to assemble in an economic method. For example, U.S. Pat. No. 5,213,265, which issued to Englhard et al. for an invention entitled "Single Valve Aspiration Type Sprayer", discloses an aspiration type sprayer for dispensing small quantities of a liquid based chemical into a stream of carrier fluid. For the device as recited in Englhard, however, the sprayer valve is attached to the top of the assembly. Thus, two hands are required to operate the assembly, which obviates any convenience advantages of the device. Further, the device disclosed by Englhard has a relatively complex construction, including at least three O-rings, to allow for operation of the device without leakage. Finally, the sprayer valve (when open) directs a solid stream of carrier fluid (water) onto a deflector plate, where it mixes with the pesticide/fertilizer. The deflector plate delivers a fan spray, and only a fan spray, of water/pesticide mixture. Stated, differently, the device is not capable of selective delivery of a water only stream, a water/product mixture stream or a water/product mixture spray.

U.S. Pat. No. 5,954,272, which issued to Liao for an invention entitled "Detergent/Water Mixing System For a Water Spray Gun", discloses a device including a gun body having a water inlet, a water outlet, a cylindrical transverse through-hole in communication with the water inlet and the water outlet, and a control valve mounted in the through-hole. Liao also discloses a detergent container which can be attached to the gun body to allow for delivery of a detergent/water mixture. There are critical differences in structure, however, between the device disclosed by Liao and the present invention which render the device of Liao inappropriate for aspiration applications.

The device of Liao has a valve body with a water chamber which is in fluid communication with the water inlet of the device and an ejector in fluid communication with the water chamber and with a detergent container. This structure causes water to be directed from the water ejector into the detergent container. The water agitates the detergent concentrate and the water flow is then directed back out of the detergent container via a guide hole which is in communication with a water outlet chamber in the valve body.

For the device disclosed by Liao, the detergent container is in fluid communication with the water inlet. Accordingly, the structure of the device disclosed by Liao causes water to be forced into the detergent container to further force an uncontrolled water/detergent mixture out of the container. There is no Venturi effect which draws water from the container, and, thus, no aspiration of detergent from the container. In fact, the sprayer assembly described by Liao is not appropriate for sensitive chemical applications. This is because the uncontrolled water flow into a chemical concentrate container yields an uncontrolled ratio of product/water mixture out of the sprayer assembly, which is an undesirable condition.

In light of the above, it is an object of the present invention to provide a sprayer assembly which has a very simple structure with an absolute minimum of parts, and yet delivers the product/water mixture without leakage. It is another object of the present invention to provide an aspiration type sprayer assembly which allows for selective delivery of a water stream, a water/product stream, or a water/product fan spray. It is another object of the present invention to provide a sprayer assembly which allows for ergonomic operation with one hand, in order to maintain more control over a container/sprayer assembly combination. Since the associated container is non-refillable, it is yet another object of the present invention to provide a sprayer assembly that has a sufficiently low manufacturing cost that the container/sprayer arrangement can be discarded when the container contents have been completely used.

SUMMARY OF THE INVENTION

A sprayer assembly in accordance with the present invention includes a housing having an elastomeric membrane that is integrally molded to the housing in a co-molding process known in the art. The membrane inner surface defines a transverse opening in the housing. An outlet aperture extends through the housing from the outer surface of the housing to the inner surface of the membrane. Similarly, a inlet orifice and an aspiration orifice exits through the housing from the housing outside surface to the inner surface of the membrane. A hollow handle and a hollow coupling are further attached to the housing. The handle defines a chamber which is in fluid communication the housing inlet orifice and the coupling allows for fluid communication with a product container.

The assembly of the present invention further includes a trigger body which is inserted in the transverse opening and rotatably mounted to the body. The trigger body is formed with an inlet port, an outlet port which is in fluid communication with the inlet port, and an aspiration port which is in communication with the outlet port.

The trigger body can be selectively rotated so that when the aspiration port is isolated from the aspiration orifice, the inlet port is in communication with the inlet orifice and the outlet port is in communication with the outlet aperture. Once the handle is connected to a water source, this alignment allows for a water only stream during operation of the present invention.

Alternatively, the valve body can be rotated so that the inlet port, outlet port and aspiration port of the body are all in fluid communication with the respective inlet orifice, outlet orifice and aspiration orifice of the housing.. This alignment creates a Venturi effect which draws product out of the container into the outlet port of the body. The concentrate product mixes with water in the outlet port, and the water/product mixture stream is directed out the outlet aperture of the housing.

Further rotation of the valve body maintains the above alignment but changes the flow path of the mixture. Specifically, the mixture stream is directed onto a deflector plate which is mounted to the outside surface of the housing. This yields a fan spray of the water/product mixture.

BRIEF DESCRIPTION OF THE DRAWINGS

The novel features of this invention will be best understood from the accompanying drawings, taken in conjunction with the accompanying description, in which similar characters refer to similar parts, and in which.

WRITTEN DESCRIPTION OF THE PREFERRED EMBODIMENTS

Figures 1, 1A:
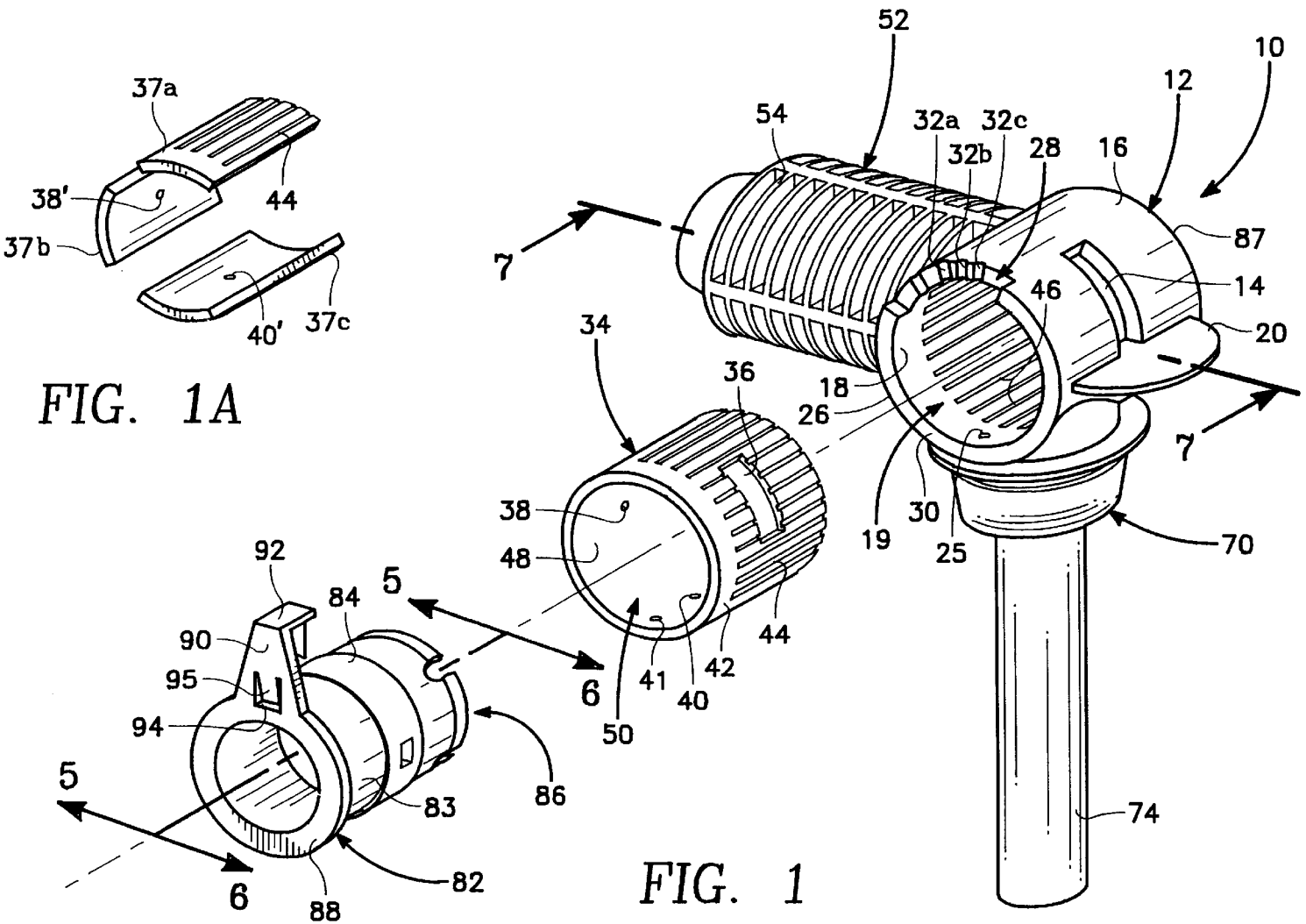
FIG. 1 is an exploded isometric view of the sprayer assembly of the present invention.
FIG. 1A is an isometric view of an alternative embodiment of the sleeve form the assembly shown in FIG. 1.

Referring to the above drawing Figures, the adjustable hose sprayer assembly of the present invention is shown and is generally designated by reference character 10. The assembly includes an annular housing 12 which is formed with a circumferential housing aperture 14. The housing aperture is oriented along the housing circumference centerline and extends through the housing wall 26 from housing outside surface 16 to housing inside surface 18.

A deflector plate 20 is attached to outside surface 16 below the lower end of housing aperture 14 so that it extends somewhat radially outward from the housing. The plate is slightly inclined towards the aperture at an acute angle a from a housing tangent to the point where the plate is fixed to the housing (See FIG. 9) for reasons to be described. As shown, the plate has a flat upper surface and a curved outer periphery. However, other shapes could be used to offset the desired spray pattern of water being deflected therefrom.

Figure 7:
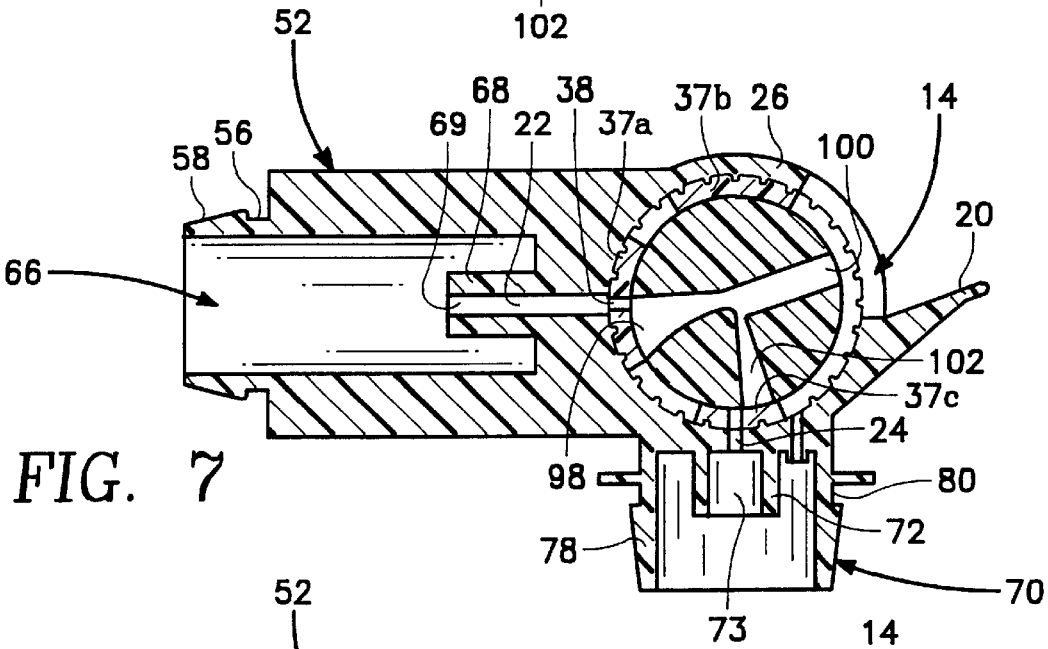
FIG. 7 is a cross-sectional view of the assembly (without the drawtube and with the sleeve embodiment of FIG. 1A) taken along lines 7—7 of FIG. 1.
Figure 8:
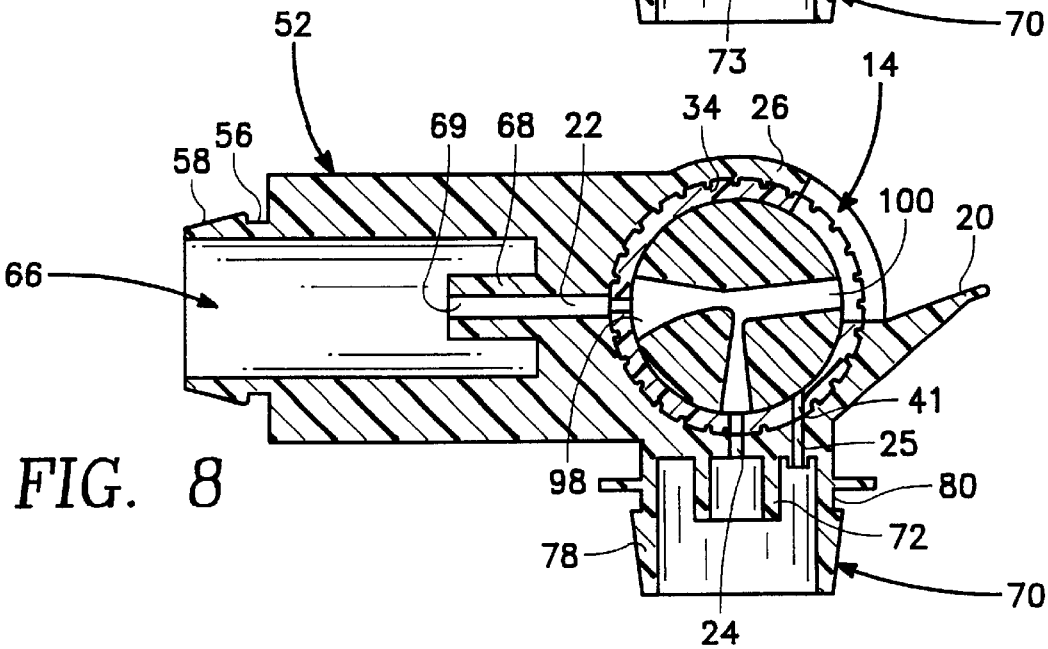
FIG. 8 is the same view as that of FIG. 7, but with the sleeve embodiment of FIG. 1 and with the valve body aligned to deliver a water/product stream.
Figure 9:
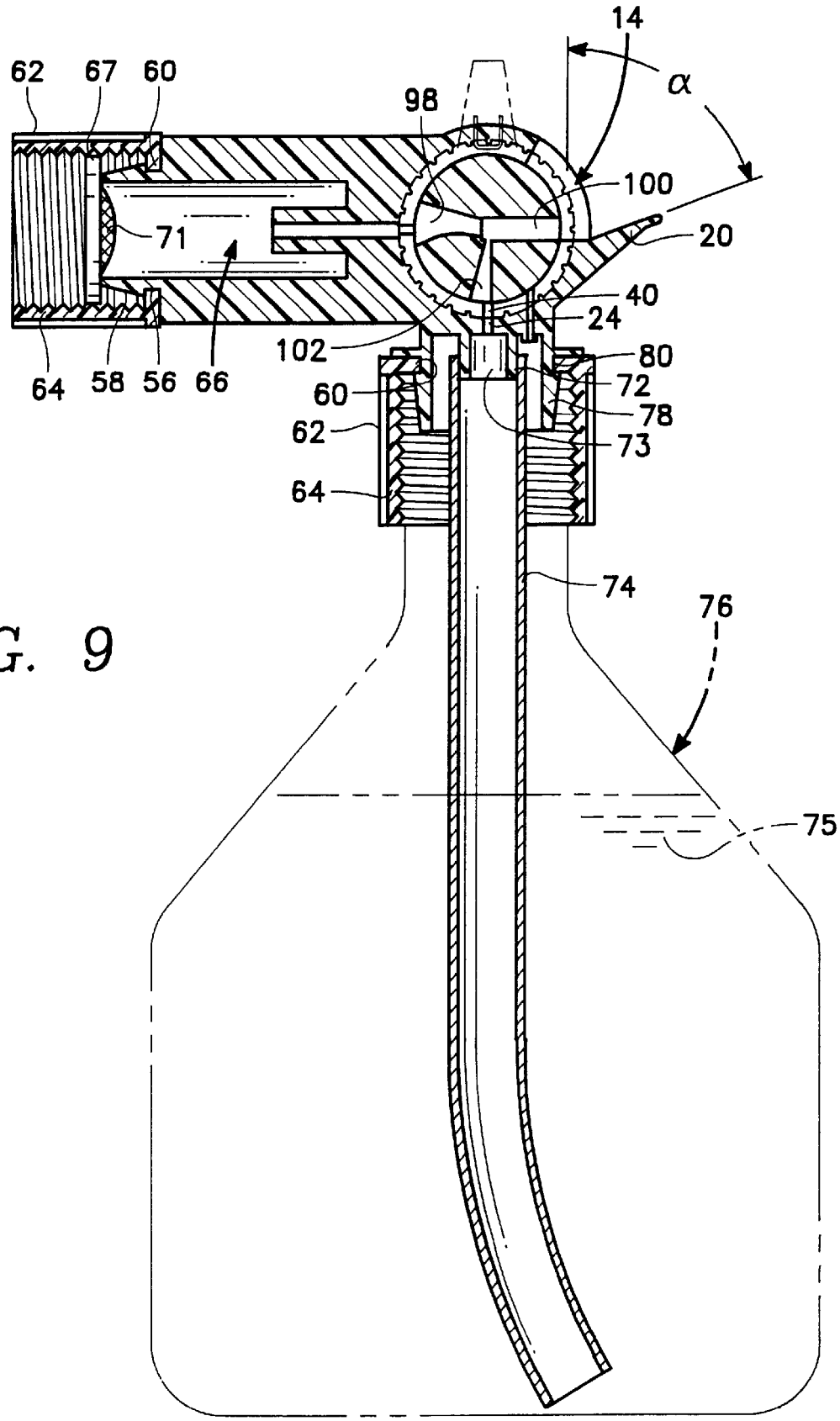
FIG. 9 is the same view as that of FIG. 8, but with the valve body aligned to deliver a waterproduct fan spray and further showing the drawtube and a product container in phantom with a reservoir of product concentrate.

The housing includes a housing inlet orifice 22, a housing aspiration orifice 24 and a housing vent 25, all of which extend through housing wall 26, as best seen in FIGS. 7–9. A trigger channel 28 is formed in the housing and extends about one quarter of the distance from annular edge 30 to the circumference centerline of the housing. A plurality of notches 32 are further formed along the inner housing edge of the trigger channel.

The assembly of the present invention further includes a cylindrical elastomeric membrane 34. The membrane is formed with a membrane aperture 36 which corresponds to housing aperture 14 and with membrane inlet orifice 38 which corresponds to housing inlet orifice 22. Similarly, the membrane is formed with membrane aspiration orifice 40 which corresponds to housing aspiration orifice 24 and with membrane vent 41 which corresponds to housing vent 25.

The membrane outer surface 42 is formed with a plurality of longitudinally extending grooves 44 which interfit with a corresponding plurality of raised ridges 46 on the housing inside surface when the membrane is within the housing. With the membrane in place within the housing, the membrane inner surface 48 defines a transverse opening 50 that is co-extensive with housing central opening 19.

In an alternative embodiment of the invention, the membrane can be broken up into a plurality of sleeve segments, of which segments 37*a*–37*c* are representative (See FIG. 1A). The segments are attached to the housing inside surface 18. The segments are oriented around the housing so that trigger body 82 is centered within transverse opening 50. The segments further provide a seal to prevent leakage of fluid out the transverse opening during operation of the assembly. As shown in FIG. 1A, one segment 37*a* has a segment orifice 38' that corresponds to housing inlet orifice 22. Another segment 37*b* has a second segment orifice 40' that corresponds to housing aspiration orifice 24. This embodiment removes the requirement for co-molding the membrane with the housing and facilitates manufacture of assembly.

The assembly of the present invention further includes a handle 52 that merges into the housing. The handle extends outwardly from the housing about perpendicular to the center of central opening 19. It is oriented so that it is centered around a longitudinal axis that is co-extensive with the inlet orifice. The handle includes a plurality of external ribs 54 to facilitate ergonomic gripping of the assembly with one hand.

As best seen in FIGS. 7–9, the free end of the handle merges into a handle throat 56 and terminates at abutment 58. As shown in FIG. 9, lip 60 of hose nut 62 is forced over the abutment so that it freely rotates around the throat. Thus, hose nut is rotatably mounted to the handle. The hose nut is formed with internal threads 64 to allow for attachment to a garden hose (not shown) in a manner known in the art. Similarly, the handle includes a coupling 70 which is formed with a coupling ridge 78 and a coupling throat 80 for similar engagement with container nut 61, in the same manner as the above-described handle abutment 58 engages handle throat. The coupling is described in greater detail below.

The interior of the handle defines an inlet chamber 66 for the overall assembly. As can be appreciated by referring to FIGS. 7–9, the assembly of the present invention includes a water inlet tube 68. The water inlet tube extends from the housing into the inlet chamber 66. The water inlet tube defines a water inlet passageway 69 in fluid communication with housing inlet orifice 22. Because the diameter of passageway 69 is less than about one fourth the diameter of chamber 66, turbulent water entering the chamber will convert to laminar flow as it passes through the passageway and enters the inlet orifice.

As shown in FIG. 9, an anti-siphon valve 67 which comprises an annular portion 67 and a screen 71 is placed over the abutment. The screen extends across the annular portion so that water must pass through the screen before entering inlet chamber 66. The screen further facilitates laminar flow in the inlet chamber and functions to prevent a reverse flow of product through the inlet chamber during operation of the assembly as described below.

As mentioned above, the assembly may also include coupling 70. Coupling 70 preferably merges into the housing at about a right angle to the handle 52. Extending downwardly within the coupling is a drawtube socket 72 the socket is similarly fixed to the housing and defines a socket opening 73 that is co-extensive with housing aspiration orifice 24, as best seen in FIGS. 7–9.

A drawtube 74 is fixed to the assembly by forcing one end of the drawtube over the drawtube socket (FIG. 9). The drawtube extends from the socket opening past the coupling and extends into a reservoir 75 of product concentrate in a container 76.

Figure 10:
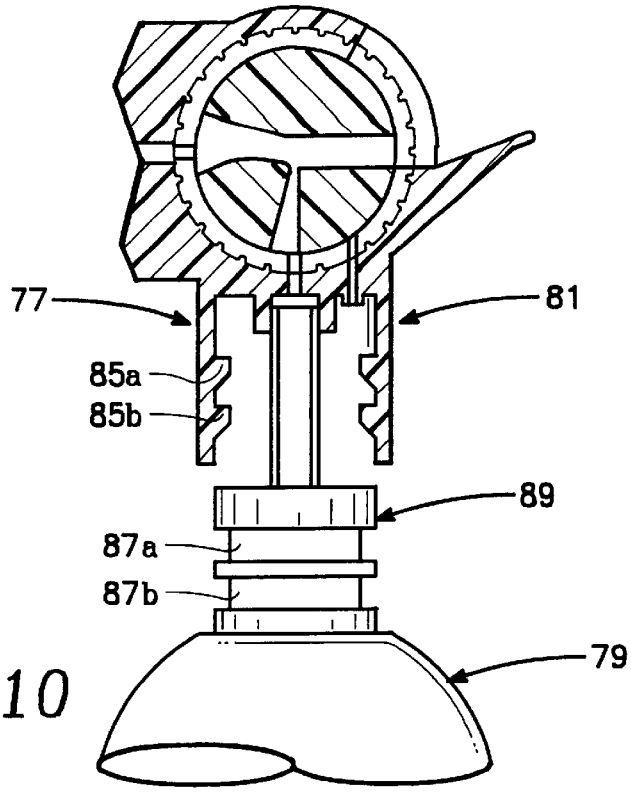
FIG. 10 is a cross-sectional view of an alternative coupling for the assembly shown in FIG. 1.
Figure 11:
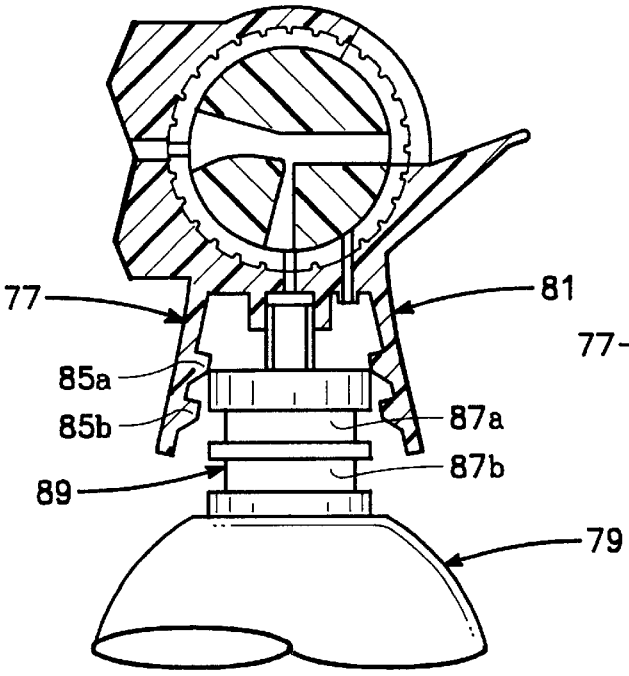
FIG. 11 is a cross-sectional view of the alternative coupling being urged onto an alternative bottle neck.
Figure 12:
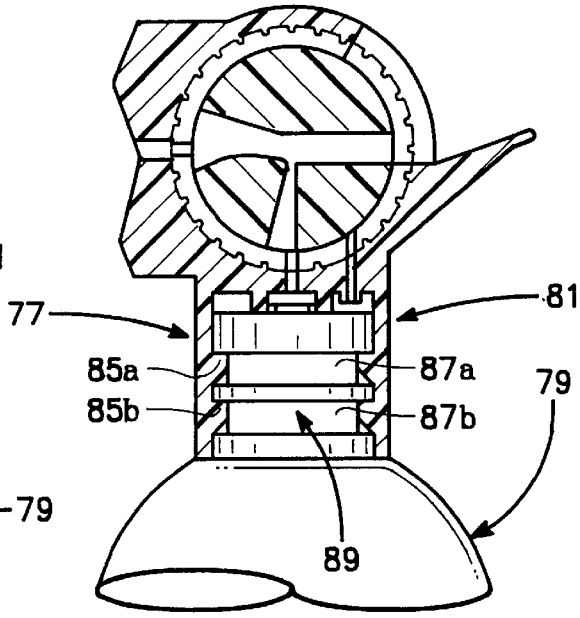
FIG. 12 is the same view as FIG. 11, but with the alternative coupling seated on the alternative bottle neck.

In an alternative embodiment of the present invention, and as shown in FIGS. 10–12, the structure of the coupling can be modified to further reduce the required number of molded parts for the assembly. Specifically, a flex coupling 77 is molded integrally with housing 12. It includes a plurality of downwardly extending arcuate snap ring segments 81. A bottle 79 is modified at the bottle neck 89 to interfit with flex coupling 77 as described below.

Each segment is formed with an upper bead 85*a* and a lower bead 85*b*. The beads interfit with respective upper groove 87*a* and lower groove 87*a* of bottle neck 89. When the bottle neck is urged into the flex coupling, the snap ring segments flex radially outward (FIG. 11). This allows the bottle neck to move further into the coupling until the beads engage the neck grooves to seat the bottle neck within the coupling (FIG. 12). The above configuration eliminates the need for a container nut in the manufacture of the assembly of the present invention.

To control the flow of water and/or product concentrate through the assembly, and referring primarily to FIGS. 2–6, a trigger body 82 is included in the assembly. The trigger body has a cylindrical sleeve portion 83 which merges into a transverse disc portion 84 which is located at the mid-portion of the trigger body length. An annular first end 86 of the trigger body includes a plurality of spaced-apart cut-outs which create a plurality of arc-shaped flexible lip sections 91*a–d*.

The second end of the trigger body is defined by an annular flange 88. A triangular portion 90 extends radially outward from the flange and merges into a thumb lever 92. The thumb lever 92 extends from triangular portion 90 back toward first end 86 over sleeve portion 83. A brace 93 is fixed perpendicularly to the thumb lever 92 underside and to the triangular portion 90 to reinforce the thumb lever during operation of the assembly. A U-shaped slot 94 is formed in the triangular portion, and the slot defines a flexible tab 95. A key 96 extends perpendicularly from the flexible tab in the same direction as thumb lever 92, for reasons to be described.

For assembly with the membrane in place within central opening 19, trigger body 82 is urged into the membrane transverse opening 50. As this occurs, the lip sections 91*a–d* flex radially inward. Once the trigger body is in place within the housing, the lip sections regain their original shape and engage housing edge 87. The flexibility of the lip sections allows the trigger body to be snap-fit into the housing so that the body is rotatable therein.

When the trigger body is snap-fit into the housing, the triangular portion is positioned within trigger channel 28. The trigger channel functions as a stop and limits the rotatable range of motion of the trigger body. Further, as the triangular portion is moved within the trigger channel, the key 96 engages one of the notches 32*a–c* in the trigger channel, according to the desires of the operator.

As mentioned above, the trigger body includes an interior thick disc portion 84. The disc portion is provided with radially extending interior flow channels comprising an inlet port 98, outlet port 100, and aspiration port 102. Each of the ports are interconnected.

Figure 2:
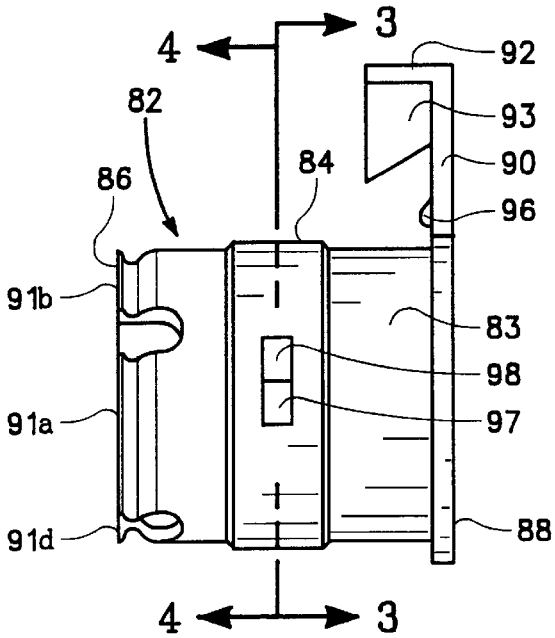
FIG. 2 is a side elevational view of the trigger body of the assembly shown in FIG. 1.
Figure 3:
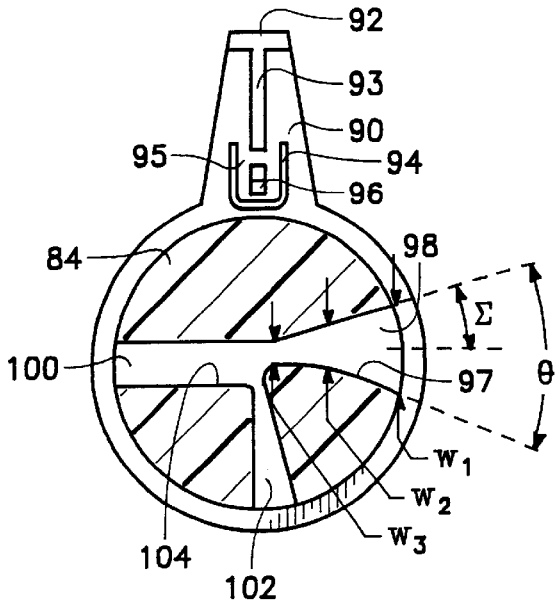
FIG. 3 is a cross-sectional view taken along lines 3—3 of FIG. 2.
Figure 4:
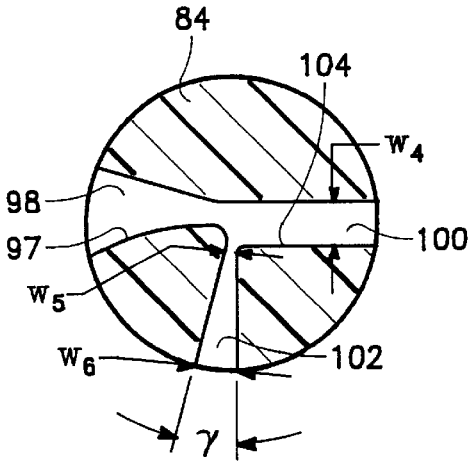
FIG. 4 is a cross-sectional view taken along lines 4—4 of FIG. 2.
Figure 6:
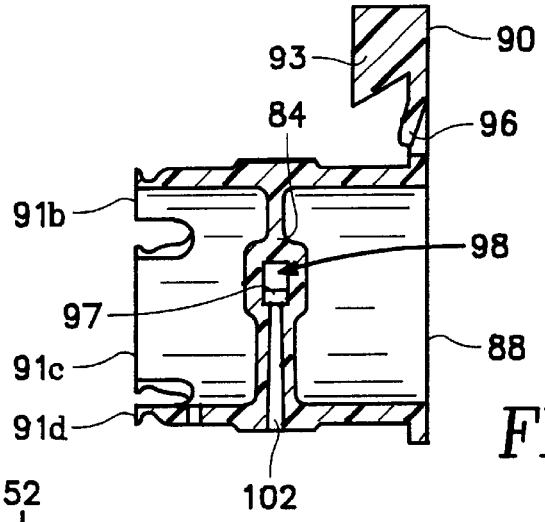
FIG. 6 is a cross-sectional view taken along lines 6—6 of FIG. 1.

As best seen in FIG. 6, the inlet port 98 has a rectangular cross-sectional profile. The cross-sectional profile is partially defined by lower inlet port surface 97 (FIGS. 2 and 3). As further indicated in FIG. 3, the inlet port 98 has an outer taper which decreases sharply from an initial width $w_1$ at the outer edge of the disc portion to a width $w_2$ at about an intermediate point about midway between the outer edge and the center of the disc portion. This outer taper is characterized by angle $\theta$ in FIG. 3.

Proceeding from the intermediate point to the center of the disc portion, the inlet port has a shallow inner taper which decreases from width $w_2$ to a minimum width $w_3$ proximate the disc portion center. This shallow inner taper is characterized by angle $\Sigma$ and is also shown in FIG. 3.

Figure 5:
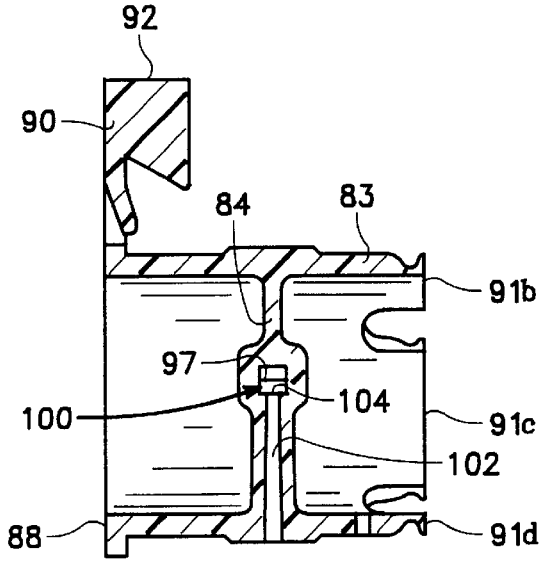
FIG. 5 is cross-sectional view taken along lines 5—5 of FIG. 1.

With reference to FIGS. 3 and 5, the outlet port 100 also has a rectangular cross-sectional profile (FIG. 5). The cross-sectional profile for the outlet is defined in part by a lower outlet port surface 104. The outlet port has a constant width $w_4$ from the center of the disc to the outer edge of the disc. The outlet port also is in fluid communication with the inlet port. The outlet port is slight offset from the inlet port, as best seen in FIGS. 3,4 and 7–9. More specifically, lower outlet port surface 104, is offset below lower inlet port surface 97, as best seen in FIG. 5. The offset relationship between the lower surfaces of the inlet port and the outlet port causes a desired water flow through the trigger body as described below.

The aspiration port 102 has a decreasing aspiration taper (characterized by the angle $\gamma$ in FIG. 4) from a maximum width $w_6$ at the outer edge of the disc to a minimum width $w_5$ near the center of the disc. The aspiration port terminates at its junction with outlet port 100.

For the materials of construction for the sprayer assembly, the housing, handle and coupling are made of a durable injection moldable plastic material and are preferably molded as a single piece to minimize the cost of manufacture. The membrane is also made of an elastomeric material such as polyurethane, rubber, rubber/polymer blend and resilient plastics, and the housing and membrane are preferably simultaneously co-molded in a manner known in the art. Similarly, the trigger body, drawtube, hose nut and container nut are preferably molded from a plastic material.

Operation

1. Water Only Stream

In the operation of the assembly of the present invention, hose nut 62 is connected to a garden hose or other suitable water source and container nut 61 is threaded onto the neck of container 76.

The handle is grasped (preferably with one hand), and trigger body 82 is rotated forward until key 96 engages notch 32*a* of the housing. This alignment places inlet port 98 of the trigger body in fluid communication with housing inlet orifice 22 and membrane inlet orifice 38. This alignment further places outlet port 100 in fluid communication with membrane aperture 36 and housing aperture 14, respectively. However, the aspiration port 102 is isolated from membrane aspiration orifice 40 and housing aspiration orifice 24. The above alignment is best seen in FIG. 7.

Water under pressure is then provided by the garden hose. The water enters the water inlet passageway 69, passes the housing inlet orifice and the membrane inlet orifice and enters the inlet port of the trigger body. The size/diameter of the housing and/or membrane inlet orifice determines the flow rate of water into the inlet port. The water stream exits the assembly, in sequence, through outlet port 100, the membrane aperture and the housing aperture.

2. Water/Product Mixture Stream

With the trigger rotated forward until key 96 engages notch 32*b,* a different alignment occurs. Specifically, the inlet port and outlet port of the trigger body remain aligned as described above, but aspiration port 102 is now in fluid communication with housing aspiration orifice 24 and membrane aspiration orifice 40. This alignment is best seen by referring to FIG. 8.

When water is provided in this alignment, the water follows the same path through the water inlet passageway and into the inlet port of the body as described above. Because the outlet port lower surface is offset from the inlet port lower surface, the water strikes the outlet port lower surface at an angle. The outlet port lower surface acts as a ramp to change the direction of water flow and deflect the flow out the outlet port. This establishes an air gap internal to the disc portion in the area where the inlet port, outlet port and aspiration port merge, and a Venturi effect is created in the aspiration port. The Venturi effect draws concentrated product from reservoir 75 through drawtube 74 and through housing aspiration orifice and membrane aspiration orifice into the aspiration port. As this occurs, the housing vent and membrane allow for air flow into the container, which allows for continued flow of product into the assembly. The size/diameter of the membrane aspiration orifice and/or housing aspiration orifice determines the rate at which product is drawn into the aspiration port.

The product concentrate mixes with the rushing water in the outlet port to establish a water/product mixture. The mixture is then forced out the assembly membrane through the membrane aperture and outlet aperture, respectively.

3. Water/Product Mixture Fan Spray

In another alternative alignment, and as best seen in FIGS. 1 and 9, the trigger body is rotated until key 96 engages notch 32*c*. In this alignment, because of the sharp outer taper of the inlet port, a path of fluid communication remains between the housing/membrane inlet orifices and the inlet port while the outlet port is rotated toward deflector plate 20. Simultaneously, the path of fluid communication between the aspiration port and the housing/membrane aspiration orifices remains the same due to the aspiration taper.

As water is provided to the assembly, the water flows through the trigger body and a Venturi effect is created to establish a water/product mixture outlet port for the water/product mixture stream alignment as described above. In this alignment, however, water is directed through the membrane and housing apertures onto deflector plate 20. This causes the mixture stream to be spread out into a fan-like spray pattern.

From the above descriptions, it can be seen that significant versatility can be achieved with the present invention. Additionally, the invention is simple to use, has a low manufacturing cost and requires no maintenance.

While the adjustable hose sprayer, as herein shown and disclosed in detail, is fully capable of obtaining the objects and providing the advantages above stated, it is to be understood that the presently preferred embodiments are merely illustrative of the invention. As such, no limitations are intended other than as defined in the appended claims.

What is claimed is:

1. A valve comprising:

a housing formed with an outer surface and an inner surface;

said housing including an elastomeric membrane integrally molded to said inner surface, said membrane having a membrane inner surface defining a transverse opening in said housing; and, a trigger body inserted into said transverse opening and rotatably mounted to said housing, said trigger body being formed with a inlet port, an outlet port in fluid communication with said inlet port and an aspiration port in fluid communication with said outlet port.

2. The valve of claim 1 wherein said housing is formed with an outlet aperture, an inlet orifice and an aspiration orifice, said outlet aperture, inlet orifice and aspiration orifice each extending through said housing from said outer surface to said membrane inner surface.

3. The valve of claim 2 wherein said trigger body is selectively aligned so that when said aspiration port is isolated from said aspiration orifice, said inlet port is in communication with said inlet orifice and said outlet port is in communication with said outlet aperture.

4. The valve of claim 2 wherein said trigger body is selectively aligned so that said inlet port is in communication with said inlet orifice, said outlet port is in communication with said outlet aperture, and said aspiration port is in communication with said aspiration orifice.

5. The valve of claim 2 further comprising:

a hollow handle having a first handle end attached to said outer surface in a surrounding relationship with said inlet orifice and having a second handle end extending radially outward from said housing, said handle defining a water passageway in fluid communication with said inlet orifice; and, a coupling having a first coupling end attached to said outer surface in a surrounding relationship with said product orifice and having a second coupling end extending radially outward from said housing, said coupling defining a product passageway in fluid communication with said aspiration orifice.

6. The valve of claim 5 wherein said handle has a longitudinal axis that is co-extensive with said inlet orifice and further comprising a water inlet tube attached to said outer surface of said housing, said water inlet tube being concentric to said longitudinal axis and extending radially outward from said housing into said water passageway.

7. The valve of claim 6 wherein said coupling defines a transverse axis that is co-extensive with said aspiration orifice and further comprising a product tube attached to said outer surface of said housing so that said product tube is concentric to said product orifice and to said coupling, said product tube extending radially outward from said housing into said product passageway.

8. The valve of claim 5 wherein said second end comprises a plurality of flexible ring segments, each ring segment having a bead extending radially inward from said segment and further comprising:

a container having a neck formed with a plurality of grooves, each groove engaging a corresponding bead when said second end is attached to said neck.

9. The valve of claim 1 wherein said inlet port is partially defined by a lower inlet port surface, said outlet port is partially defined by a lower offset surface and said lower offset surface is offset from lower inlet port surface.

10. The valve of claim 1 further comprising a deflector plate attached to said outer surface of said housing proximate to said outlet aperture, said deflector plate extending radially outward from said housing.

11. A hose sprayer assembly comprising:

a housing formed with a transverse opening and having a water passageway in fluid communication with said transverse opening, and further having a product passageway in fluid communication with said transverse opening;

a trigger valve inserted into said transverse opening, said trigger valve being formed with a water port, a mixture port in fluid communication with said water port and a product port in fluid communication with said mixture port;

said housing having an inner surface and an outer surface and an outlet aperture extending from said inner surface to said outer surface; and, said trigger valve being selectively aligned so that when said product port is simultaneously isolated from said product passageway, said water port is in communication with said water passageway and said mixture port is in communication with said outlet aperture.

12. The assembly of claim 11 wherein said trigger valve is selectively aligned so that said water port is in communication with said water passageway, said mixture port is in communication with said outlet aperture, and said product port is in communication with said product passageway.

13. The assembly of claim 11 wherein said mixture port is offset from said water port.

14. The assembly of claim 11 wherein said water passageway has a longitudinal axis and further comprising a water inlet tube attached to said outer surface of said housing, said water inlet tube being coextensive with said longitudinal axis and extending outward from said housing into said water passageway.

15. The assembly of claim 14 wherein said product passageway defines a transverse axis and further comprising a product tube attached to said outer surface of said housing so that said product tube is co-extensive with said transverse axis, said product tube extending outward from said housing into said product passageway.

16. The assembly of claim 15 further comprising a deflector plate attached to said outer surface of said housing proximate to said outlet aperture, said deflector plate extending radially outward from said housing.

17. A method for spraying an aspirated liquid/liquid mixture comprising the steps of:

A) providing an annular housing formed with an outer surface and an inner surface;

B) integrally molding an elastomeric membrane having a membrane inner surface to said inner surface, said membrane inner surface defining a transverse opening in said housing;

C) inserting a trigger body into said opening, said trigger body being formed with an inlet port, an outlet port in fluid communication with said inlet port, and an aspiration port in fluid communication with said outlet port;

D) rotatably mounting said trigger body in said housing; and

E) simultaneously placing said inlet port in fluid communication with a pressurized first liquid source and placing said aspiration port in fluid communication with a second liquid source.

* * * * *

US006471141C1

(12) EX PARTE REEXAMINATION CERTIFICATE (5640th)

United States Patent
Smith et al.

(10) Number: US 6,471,141 C1
(45) Certificate Issued: Dec. 26, 2006

(54) HOSE SPRAYER ASSEMBLY

(75) Inventors: Martin E. Smith, Camarillo, CA (US); Stuart Daley, Simi Valley, CA (US); James J. Styne, San Ramon, CA (US); Stephen R. Dennis, Danville, CA (US)

(73) Assignee: Dispensing Technologies, L.L.C., Simi Valley, CA (US)

Reexamination Request:
No. 90/006,814, Oct. 20, 2003

Reexamination Certificate for:

| | |
|---|---|
| Patent No.: | **6,471,141** |
| Issued: | **Oct. 29, 2002** |
| Appl. No.: | **09/745,381** |
| Filed: | **Dec. 26, 2000** |

Related U.S. Application Data

(60) Provisional application No. 60/210,410, filed on Jun. 8, 2000.

(51) Int. Cl.
*A62C 5/02* (2006.01)

(52) U.S. Cl. ..... 239/10; 239/310; 239/318; 239/340; 239/414; 239/581.1; 137/893

(58) Field of Classification Search ..... None
See application file for complete search history.

(56) References Cited

U.S. PATENT DOCUMENTS 3,212,716 A * 10/1965 Mills et al. ..... 239/318

* cited by examiner

*Primary Examiner*—Michael O'Neill

(57) ABSTRACT

A hose sprayer assembly in accordance with the present invention includes a trigger body which is rotatably mounted within a housing. The housing is formed with an inlet orifice, an outlet aperture and an aspiration orifice, and further includes a deflector plate which is fixed to the outer surface of the housing proximate the outlet aperture. The trigger body includes a inlet port, an outlet port in fluid communication with the inlet port, and an aspiration port in fluid communication with the outlet port. Selective alignment of the trigger body places the inlet port and outlet port in fluid communication with the respective inlet orifice and outlet aperture of the housing. This yields a water only stream out the housing outlet aperture when water is forced through the assembly. Similarly, the body can be aligned to place the aspiration port in fluid communication with the aspiration orifice of the housing. When the assembly is coupled to a container filled with product concentrate, this alignment yield a water/product stream. Yet another alignment directs the water/product stream onto the deflector plate to yield a fan-like spray pattern.

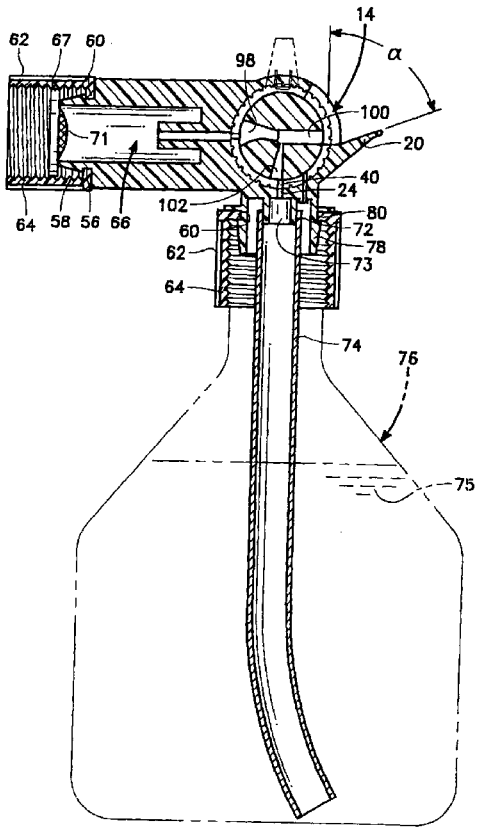

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–10 and 17 is confirmed. Claims 11–16 are cancelled.

* * * * *